US011113999B2

(12) United States Patent
Hu et al.

(10) Patent No.: US 11,113,999 B2
(45) Date of Patent: Sep. 7, 2021

(54) DATA PROCESSING METHOD, DISPLAY DEVICE, AND COMPUTER-READABLE STORAGE MEDIUM

(71) Applicants: Chongqing HKC Optoelectronics Technology Co., Ltd., Chongqing (CN); HKC Corporation Limited, Guangdong (CN)

(72) Inventors: Yunchuan Hu, Chongqing (CN); Wenqin Zhao, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 355 days.

(21) Appl. No.: 16/241,926

(22) Filed: Jan. 7, 2019

(65) Prior Publication Data

US 2020/0074899 A1 Mar. 5, 2020

Related U.S. Application Data

(63) Continuation of application No. PCT/CN2018/111533, filed on Oct. 24, 2018.

(30) Foreign Application Priority Data

Sep. 3, 2018 (CN) ..... 201811024524.9

(51) Int. Cl.

| | |
|---|---|
| ***G09G 3/00*** | (2006.01) |
| ***G09G 5/18*** | (2006.01) |
| ***G09G 3/36*** | (2006.01) |

(52) U.S. Cl.

CPC ..... *G09G 3/006* (2013.01); *G09G 3/3607* (2013.01); *G09G 5/18* (2013.01); *G09G 2320/0242* (2013.01)

(58) Field of Classification Search

CPC ..... G09G 3/006; G09G 3/3607; G09G 5/18; G09G 2320/0242

USPC ..... 324/760.01

See application file for complete search history.

(56) References Cited

U.S. PATENT DOCUMENTS

| | | | | |
|---|---|---|---|---|
| 5,760,913 | A * | 6/1998 | Falk | H04N 1/6033 358/504 |
| 5,793,406 | A * | 8/1998 | Trask | H04N 1/4076 347/252 |
| 2006/0061842 | A1* | 3/2006 | Oka | H04N 9/69 358/522 |
| 2008/0137745 | A1* | 6/2008 | Lai | H04N 19/433 375/240.16 |
| 2008/0238934 | A1 | 10/2008 | Daly et al. | |
| 2009/0003441 | A1* | 1/2009 | Sekiguchi | H04N 19/147 375/240.13 |

(Continued)

FOREIGN PATENT DOCUMENTS

| | | | |
|---|---|---|---|
| CN | 106328083 | A | 1/2017 |
| CN | 107342064 | A | 11/2017 |

(Continued)

*Primary Examiner* — David T Welch

(57) ABSTRACT

Disclosed is a data processing method, the data processing method includes: determining image data captured in preset grayscale; determining first compensation data of display defect according to the image data; and generating compensation data of the display defect according to the first compensation data and data of the preset grayscale.

17 Claims, 5 Drawing Sheets

(56) References Cited

U.S. PATENT DOCUMENTS

2009/0135211 A1 5/2009 Wang et al.
2012/0062609 A1* 3/2012 Jeon ..... G09G 3/3208 345/690
2013/0093783 A1* 4/2013 Sullivan ..... G06T 11/001 345/601
2014/0168039 A1* 6/2014 Kim ..... G09G 3/3208 345/82
2015/0187328 A1* 7/2015 Kim ..... G09G 5/02 345/690
2016/0260368 A1* 9/2016 Zheng ..... G09G 3/36
2017/0039953 A1* 2/2017 Lee ..... G09G 3/3233
2017/0069273 A1* 3/2017 Park ..... G09G 3/3233
2018/0013928 A1* 1/2018 Shaw ..... B41J 2/17546
2018/0013929 A1* 1/2018 Tang ..... H04N 1/6052
2018/0047368 A1* 2/2018 Luo ..... G09G 5/10
2018/0122282 A1* 5/2018 He ..... G09G 3/2088
2018/0158434 A1* 6/2018 Bian ..... G09G 5/10
2018/0182278 A1* 6/2018 Kim ..... G09G 3/2018
2018/0218693 A1* 8/2018 Zhang ..... G09G 3/3607
2018/0357950 A1* 12/2018 Deng ..... G09G 5/06
2018/0357951 A1* 12/2018 Deng ..... G09G 3/3208
2019/0132001 A1* 5/2019 Deng ..... H03M 7/3071
2019/0147801 A1* 5/2019 Chu ..... G09G 3/3233 345/76
2019/0149693 A1* 5/2019 Cao ..... H04N 1/6027 382/167
2019/0182509 A1* 6/2019 Kim ..... H04N 19/186
2019/0200022 A1* 6/2019 Deng ..... H04N 19/105
2019/0206370 A1* 7/2019 Jiang ..... G09G 5/10
2019/0385525 A1* 12/2019 Jin ..... G09G 3/3208
2020/0035142 A1* 1/2020 Chen ..... G09G 3/2007

FOREIGN PATENT DOCUMENTS

CN 107464524 A 12/2017
CN 107799065 A 3/2018
CN 107863080 A 3/2018
CN 108196793 A 6/2018
CN 108364615 A 8/2018

* cited by examiner

| | | | | | | | | |
|---|---|---|---|---|---|---|---|---|
| Addr0 | bit | D6 | D5 | D4 | D3 | D2 | D1 | D0 |
| Addr1 | bit | D6 | D5 | D4 | D3 | D2 | D1 | D0 |

DATA PROCESSING METHOD, DISPLAY DEVICE, AND COMPUTER-READABLE STORAGE MEDIUM

CROSS REFERENCE TO RELATED APPLICATIONS

The present application is a Continuation Application of PCT Application No. PCT/CN2018/111533 filed on Oct. 24, 2018, which claims the benefit of Chinese Patent Application No. 201811024524.9 filed on Sep. 3, 2018. All the above are hereby incorporated by reference.

FIELD

The present disclosure relates to the field of liquid crystal display technology, and more particularly relates to a data processing method, a display device, and a computer-readable storage medium.

BACKGROUND

With the continuous improvement of science and technology, more and more apparatus with display devices, such as televisions, mobile phones and so on, have entered people's daily life and work. In the field of display technology, mura (display defect) is commonly caused due to uneven brightness or chromaticity, and a compensation could be used to repair or avoid the mura. In the compensation, compensation data needs to be recorded into a memory of the display device, so that when display, the compensation data in the memory is called to overcome the mura.

However, at present, the amount of compensation data stored in the memory is large, which takes up too much memory space, increasing the costs of the memory. As the memory is set in a timing sequence controller, the costs of the timing sequence controller is high, thus affecting use.

SUMMARY

It is one main objective of the present disclosure to provide a data processing method, a display device, and a computer-readable storage medium, aiming to solve the problem in the prior art that the amount of compensation data stored in the memory is large, which takes up too much memory space, increasing the costs of the memory; and as the memory is set in a timing sequence controller, the costs of the timing sequence controller is high, thus affecting use.

In order to realize the above aim, the present disclosure provides a data processing method, the data processing includes:

determining image data captured in preset grayscale;

determining first compensation data of display defect according to the image data; and generating compensation data of the display defect according to the first compensation data and the data of the preset grayscale.

Optionally, the step of generating compensation data of the display defect according to the first compensation data and the data of the preset grayscale includes:

generating grayscale compensation data of the display defect, according to the first compensation data and grayscale data of the preset grayscale, when the compensation data is the grayscale compensation data; and generating color deviation compensation data of the display defect, according to the first compensation data and chrominance data of the preset grayscale, when the compensation data is the color deviation compensation data.

Optionally, the step of determining first compensation data of display defect according to the image data includes:

captured images including a plurality of image data, when the preset grayscale includes a plurality of grayscale data;

respectively determining a plurality of second compensation data of the display defect according to the plurality of image data; and calculating the first compensation data of the display defect, according to the plurality of second compensation data and a preset calculation manner.

Optionally, the step of determining first compensation data of display defect according to the image data includes:

acquiring a compensation precision of the display defect; and determining the first compensation data of the display defect according to the compensation precision and the image data.

Optionally, after the step of generating compensation data of the display defect according to the first compensation data and the data of the preset grayscale, the data processing method further includes:

recording the first compensation data into a memory of a display apparatus; and repairing the display defect according to the compensation data which is generated by the recorded first compensation data and the data of the preset grayscale, when compensating a display image.

Optionally, after the step of determining image data captured in preset grayscale, the data processing method further includes:

determining whether the display defect is existed in a display apparatus according to the image data and a preset identification algorithm; and if yes, performing the step of determining the first compensation data of display defect according to the image data.

Optionally, the preset identification algorithm includes identification manners of contrast enhancement, brightness gradient, and color deviation calculation.

Optionally, after the step of generating compensation data of the display defect according to the first compensation data and the data of the preset grayscale, the data processing method further includes:

recording the first compensation data into a memory of a display apparatus; and repairing the display defect according to the compensation data which is generated by the recorded first compensation data and the data of the preset grayscale, when compensating a display image.

Optionally, the step of recording the first compensation data into a memory of a display apparatus includes:

compressing the first compensation data; and recording the compressed first compensation data into the memory of the display apparatus.

Optionally, the step of compressing the first compensation data includes:

acquiring a first compensation data table of the display device, and extracting the compensation data according to an extraction period including four adjacent rows based on the first compensation data table.

Optionally, the step of extracting the compensation data according to an extraction period including four adjacent rows based on the first compensation data table includes:

extracting the compensation data of odd columns in the first row;

extracting the compensation data of even columns in the third row and extracting the compensation data of the first column in the third row.

Optionally, the step of determining first compensation data of display defect according to the image data includes:

captured images including a plurality of image data, when the preset grayscale includes a plurality of grayscale data;

respectively determining a plurality of second compensation data of the display defect according to the plurality of image data; and calculating the first compensation data of the display defect, according to the plurality of second compensation data and a preset calculation manner.

Optionally, the step of determining first compensation data of display defect according to the image data includes:

acquiring a compensation precision of the display defect; and determining the first compensation data of the display defect according to the compensation precision and the image data.

In addition, in order to realize the above aim, the present disclosure further provides a display device. The display device includes a memory, a processor, and a computer program stored on the memory and executable on the processor, the computer program being executed by the processor to implement the following steps:

determining image data captured in preset grayscale;

determining first compensation data of display defect according to the image data; and generating compensation data of the display defect according to the first compensation data and the data of the preset grayscale.

Optionally, the display device includes a display panel and a timing sequence controller connected to the display panel, the timing sequence controller is loaded with a data processing control device, and the display panel performs display under the control of the timing sequence controller.

Optionally, the step of generating compensation data of the display defect according to the first compensation data and the data of the preset grayscale includes:

generating grayscale compensation data of the display defect, according to the first compensation data and grayscale data of the preset grayscale, when the compensation data is the grayscale compensation data; and generating color deviation compensation data of the display defect, according to the first compensation data and chrominance data of the preset grayscale, when the compensation data is the color deviation compensation data.

Optionally after the step of generating compensation data of the display defect according to the first compensation data and the data of the preset grayscale, the data processing method further includes:

recording the first compensation data into a memory of a display apparatus; and repairing the display defect according to the compensation data which is generated by the recorded first compensation data and the data of the preset grayscale, when compensating a display image.

Optionally, the step of determining first compensation data of display defect according to the image data includes:

captured images including a plurality of image data, when the preset grayscale includes a plurality of grayscale data;

respectively determining a plurality of second compensation data of the display defect according to the plurality of image data; and calculating the first compensation data of the display defect, according to the plurality of second compensation data and a preset calculation manner.

Optionally, the step of determining first compensation data of display defect according to the image data includes:

acquiring a compensation precision of the display defect; and determining the first compensation data of the display defect according to the compensation precision and the image data.

In addition, in order to realize the above aim, the present disclosure further provides a computer-readable storage medium. The computer-readable storage medium stores a data processing program, the data processing program when being executed by a processor performs the following steps:

determining image data captured in preset grayscale;

determining first compensation data of display defect according to the image data; and generating compensation data of the display defect according to the first compensation data and the data of the preset grayscale.

In the present disclosure, image data is captured by preset grayscale, and the compensation data of display defect is determined according to the captured image data. Because a part of the compensation data is stored in the memory, the other part is embodied in the form of the data of the preset grayscale. As such, there is no need to store the whole data of each compensation data, which reduces the storage space occupied by the compensation data, cuts the demands for the memory, saves the costs of the memory, and improves the operation efficiency of the timing sequence controller.

The realizing of the aim, functional characteristics and advantages of the present disclosure are further described in detail with reference to the accompanying drawings and the embodiments.

DETAILED DESCRIPTION OF THE EMBODIMENTS

It should be understood that, the following description is of exemplary embodiments only and is not intended to limit the present disclosure.

The main solution of the embodiment of the present disclosure is: determining image data captured in preset grayscale; determining first compensation data of display defect according to the image data; and generating compensation data of the display defect according to the first compensation data and data of the preset grayscale.

Since the amount of compensation data stored in the memory is large, which takes up too much memory space, increasing the costs of the memory. Besides the memory is set in a timing sequence controller, which increases the costs of the timing sequence controller, and affects its use. In the present disclosure, image data is captured by preset grayscale, and the compensation data of display defect is determined according to the captured image data. Because a part of the compensation data is stored in a memory, the other part is embodied in the form of the data of the preset grayscale. As such, there is no need to store the whole data of each compensation data, which reduces the storage space occupied by the compensation data, cuts the demands for the memory, saves the costs of the memory, and improves the operation efficiency of the timing sequence controller.

Figure 1:
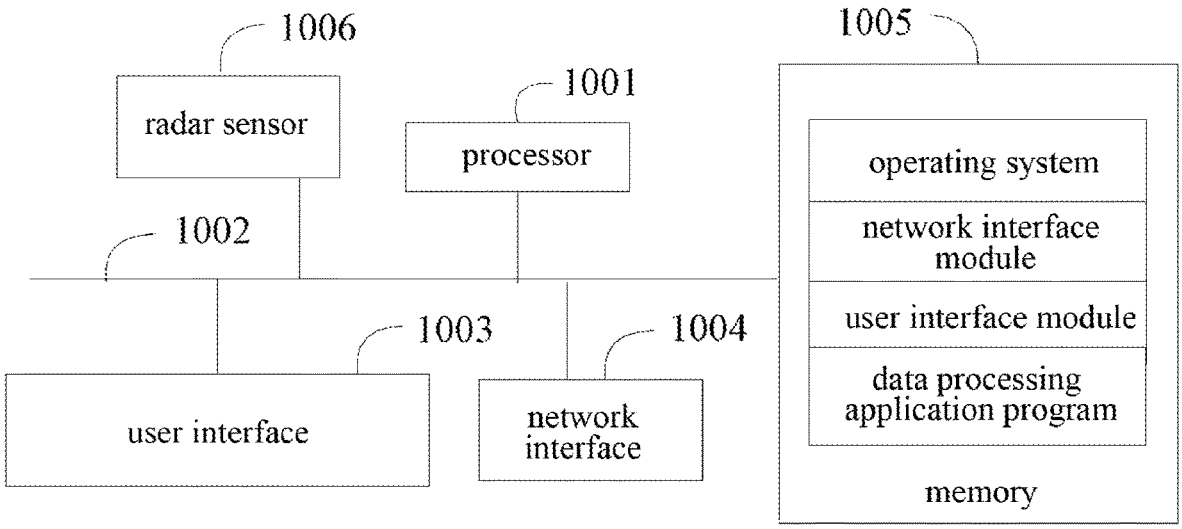
FIG. 1 is a structural diagram of a display device in terms of hard operating environment involved in the embodiments of the present disclosure.

As shown in FIG. 1, FIG. 1 is a structural diagram of a display device in terms of hard operating environment involved in the embodiments of the present disclosure.

As shown in FIG. 1, the display device may include a processor 1001, a network interface 1004, a user interface 1003, a memory 1005, and a communication bus 1002. The communication bus 1002 is configured to enable connection communication between these components. The user interface 1003 may include a display, an input unit such as a keyboard, and the optional user interface 1003 may also include a standard wired interface and a wireless interface. The network interface 1004 may optionally include a standard wired interface, a wireless interface (such as a Wi-Fi interface). The memory 1005 may be an SRAM memory or a non-volatile memory, such as a disk memory. The memory 1005 may alternatively be a memory device separate from the aforementioned processor 1001.

Alternatively, the display device may also include a camera, a radio frequency circuit, a sensor, an audio circuit, a WiFi module, and the like.

It will be understood by those skilled in the art that, the terminal structure shown in FIG. 1 does not constitute a definition of the display device, and may include more or fewer components than shown, or some components may be combined, or different component arrangements.

As shown in FIG. 1, a memory 1005 as a computer-readable storage medium may include an operating system, a network communication module, a user interface module, and a data processing application program.

In the display device shown in FIG. 1, the network interface 1004 is mainly configured to connect with the background server for data communication with the background server. The user interface 1003 is mainly configured to connect the client (client) and communicate data with the client. While processor 1001 may be configured to invoke a data processing application stored in memory 1005 and perform the following operations:

determining image data captured in preset grayscale;

determining first compensation data of display defect according to the image data; and generating compensation data of the display defect according to the first compensation data and the data of the preset grayscale.

Further, the processor 1001 may be configured to invoke the data processing application stored in the memory 1005 and perform the following operations:

generating grayscale compensation data of the display defect, according to the first compensation data and grayscale data of the preset grayscale, when the compensation data is the grayscale compensation data; and generating color deviation compensation data of the display defect, according to the first compensation data and chrominance data of the preset grayscale, when the compensation data is the color deviation compensation data.

Further, after the step of determining the image data captured using the preset grayscale, the processor 1001 may be configured to invoke the data processing application stored in the memory 1005 and perform the following operations:

determining whether the display defect is existed in a display apparatus according to the image data and a preset identification algorithm; and if yes, performing the operation of determining the first compensation data of display defect according to the image data.

Further, the processor 1001 may be configured to invoke the data processing application stored in the memory 1005 and perform the following operations: the preset identification algorithm includes identification manners of contrast enhancement, brightness gradient and color deviation calculation.

Further, after the step of generating compensation data for displaying defects according to the first compensation data and data in preset grayscale, the processor 1001 may be configured to call the data processing application stored in the memory 1005 and perform the following operations:

recording the first compensation data into a memory of a display apparatus; and repairing the display defect according to the compensation data which is generated by the recorded first compensation data and the data of the preset grayscale, when compensating a display image.

Further, the processor 1001 may be configured to invoke the data processing application stored in the memory 1005 and perform the following operations:

compressing the first compensation data; and recording the compressed first compensation data into the memory of the display apparatus.

Further, the processor 1001 may be configured to invoke the data processing application stored in the memory 1005 and perform the following operations:

captured images including a plurality of image data, when the preset grayscale includes a plurality of grayscale data;

respectively determining a plurality of second compensation data of the display defect according to the plurality of image data; and calculating the first compensation data of the display defect, according to the plurality of second compensation data and a preset calculation manner.

Further, the processor 1001 may be configured to invoke the data processing application stored in the memory 1005 and perform the following operations:

acquiring a compensation precision of the display defect; and determining the first compensation data of the display defect according to the compensation precision and the image data.

Figure 2:
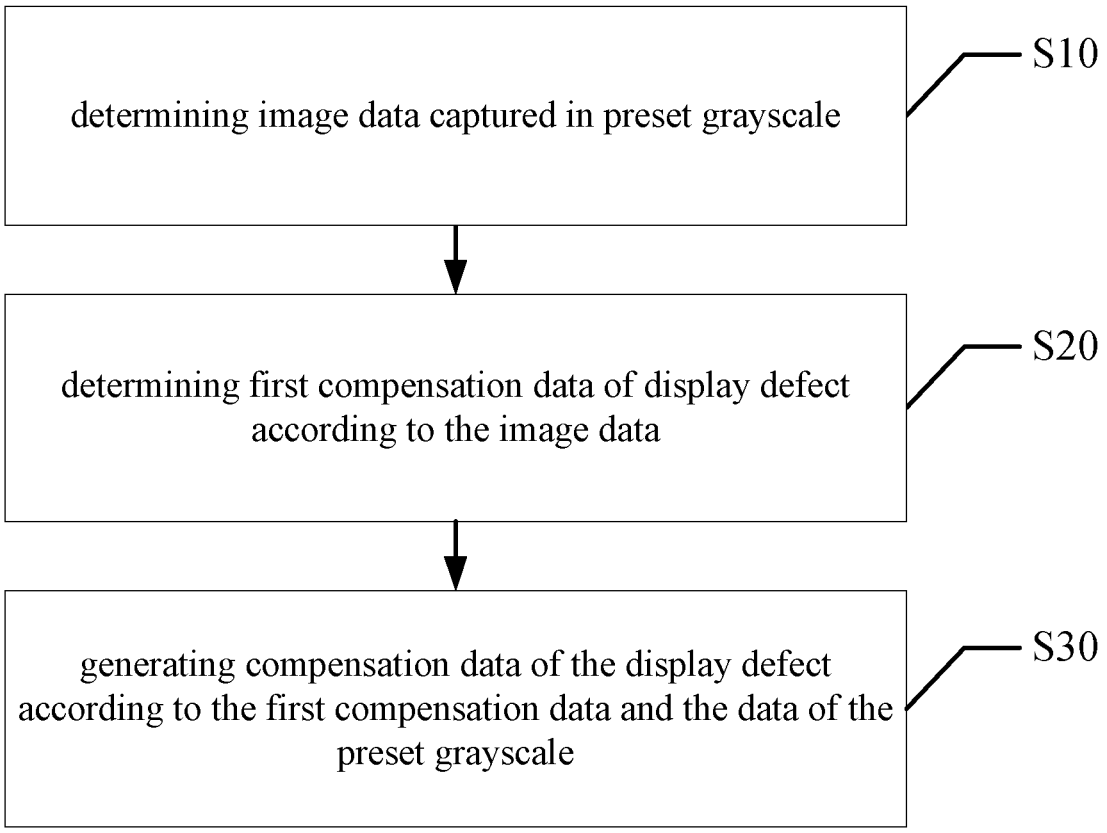
FIG. 2 is a flowchart diagram of an embodiment of the data processing method of the present disclosure.

Referring to FIG. 2, an embodiment of the present disclosure provides a data processing method, the data processing method includes:

step S10: determining image data captured in preset grayscale;

In this embodiment, when display data needs to be compensated, namely, when demura data is needed, image data of the displayed image is captured by the CCD camera, and the displayed image is captured in preset grayscale. For example, the preset grayscale may be grayscale A or grayscale B, and the preset grayscale may be grayscale of RGB three-color, or grayscale of monochrome, which is set according to actual needs. The image data captured in grayscale is the grayscale data, and captured in RGB is the RGB data. The resolution and precision requirements of the CCD are relatively high, so a high-precision and high-resolution CCD lens is used for capturing. Generally, the CCD camera with high-precision and high-resolution is used to capture the detected images. The choice of camera resolution depends on the resolution, size, capturing distance and demura compensation precision of the detected panel, to achieve the best detection and compensation effect. The final data obtained by the camera must be XYZ data, and the subsequent calculations are based on the XYZ data captured by the camera. The CCD capture must conform to the effect of human eye identification, and reach the resolution of human eye. After the image data of the display image displayed by the display device is captured by the CCD, namely, the image data captured in the preset grayscale is determined, the image data is determined by manners of remote operation or copy.

step S20, determining first compensation data of display defect according to the image data;

After the image data is determined, the first compensation data of the display defect is determined according to the image data. The first compensation data is data for compensation in addition to the data of the preset grayscale. After determining the image data, whether there is mura (display defect) is identified based on the image data, and after the mura is identified, the first compensation data of the display defect is determined based on the mura. The compensation data corresponds to the mura. Mura is well identified and the compensation data is determined more accurately, so the key lies in how to identify mura's existence. Of course, after identifying the mura, the mura corresponds to the compensation data, or different attempting data is correspondingly set according to mura type and severity. The compensation data is grayscale data compensation. In other embodiments, RGB color data may be used for compensation. And the compensation in the color data and the compensation in the grayscale data could be switched.

Optionally, after the step of determining image data captured in preset grayscale, the method further includes: determining whether a display device has the display defect according to the image data and a preset identification algorithm; and performing the operation of determining first compensation data of display defect according to the image data, when having the display defect. The preset identification algorithm includes identification manners of contrast enhancement, brightness gradient and color difference calculation. After specific contrast enhancement, the mura, which is originally weak and not easy to be identified, could be clearly identified. Of course, there are many other ways, for example, comparing the brightness differences between a pixel and its surrounding pixels, calculating brightness gradient, and calculating color deviation, and so on.

step S30, generating compensation data of the display defect according to the first compensation data and the data of the preset grayscale.

After determining the first compensation data of the display defect, this part of the compensation data needs to be recorded into the memory. Specifically, after the step of generating compensation data of the display defect according to the first compensation data and data of the preset grayscale, the method further includes: recording the first compensation data into a memory of a display device; repairing the display defect according to the compensation data which is generated by the recorded first compensation data and the data of the preset grayscale, when compensating a display image. The data of the preset grayscale needs not be written into the memory, in other words, the part, the data of the preset grayscale in each compensation data, needs not be stored. As such, the space occupied by the compensation data in the memory could be reduced.

Figures 3, 4:
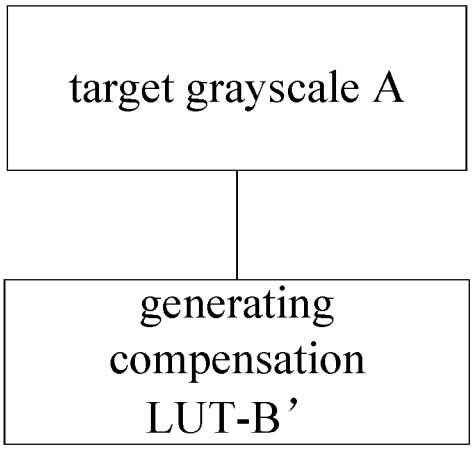
FIG. 3 is a flowchart diagram of generating the compensation data in an embodiment of the present disclosure.
FIG. 4 is a schematic diagram of storing the compensation data in an embodiment of the present disclosure.

Specifically, in order to better describe the data processing method of the embodiment according to the present disclosure, the data processing includes:

The compensation data stored is in the form of a relative value. Taking UHD (3840*2160) as an example, the sampling point data is (481*271). As shown in FIG. 3, an 8 bit compensation LUT (represented by b') is generated after being captured by a CCD camera with a target grayscale A and then processed by the MCU, namely, B=B'+A, the highest bit is a symbol bit, which represents positive or negative compensation of data. Usually, it's to capture 3 layers, and the compensation data is about 3.2 Mbit. The data storage manner of flash capacity is shown in FIG. 4, one address stores one compensation data, which saves flash capacity, reduces record-in reading time, and improves work efficiency, so as to avoid capacity loss due to compensation speed. However, before adopting the method of this embodiment, the compensation LUT is 10 bit data, the compensation data is 4 Mbit, so that one compensation data is stored in two addresses.

When recording the first compensation data into the memory, first, the first compensation data could be compressed, to further reduce the space occupied by the first compensation data. The compression way may be as follows: acquiring a demura table (a first compensation data table) of the display device, and extracting the compensation data according to an extraction period including four adjacent rows based on the first compensation data table; arranging the extracted compensation data in sequence to obtain a compressed demura table; storing the compressed demura table in memory. The step of extracting the compensation data from the demura table according to the extraction period includes: extracting the compensation data of odd columns in the first row; extracting the compensation data of even columns in the third row and extracting the compensation data of the first column in the third row. By the compression way, the occupied space is further reduced and the costs is saved.

In the present disclosure, image data is captured by preset grayscale, and the compensation data of display defect is determined according to the captured image data. Because a part of the compensation data is stored in a memory, the other part is embodied in the form of the data of the preset grayscale. As such, there is no need to store the whole data of each compensation data, which reduces the storage space occupied by the compensation data, cuts the demands for the memory, saves the costs of the memory, and improves the operation efficiency of the timing sequence controller.

Figure 5:
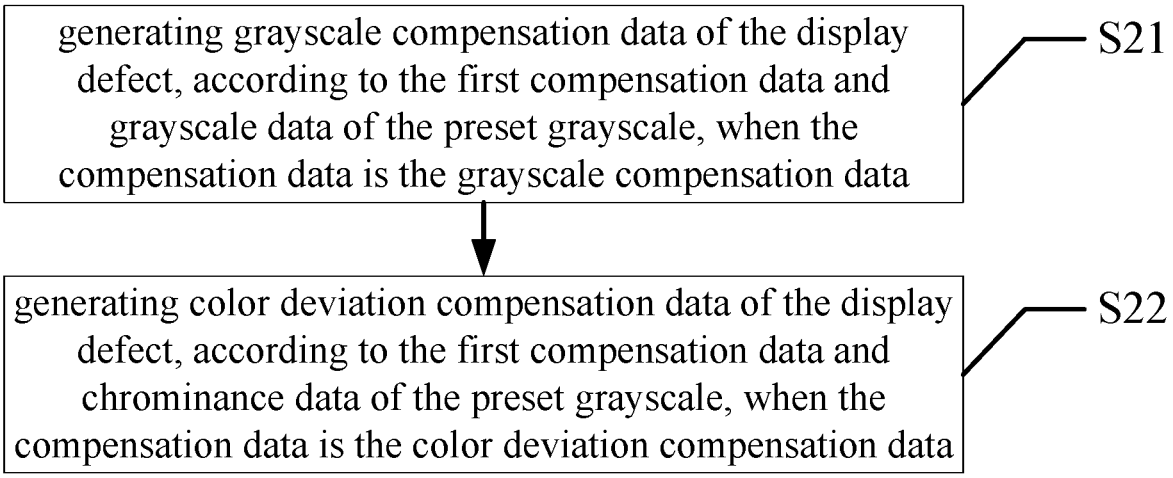
FIG. 5 is a flowchart diagram of generating compensation data of the display defect according to the first compensation data and the data of the preset grayscale in an embodiment of the present disclosure.

In some embodiments, referring to FIG. 5, the step of generating compensation data of the display defect according to the first compensation data and data of the preset grayscale includes:

step S21, generating grayscale compensation data of the display defect, according to the first compensation data and grayscale data of the preset grayscale, when the compensation data is the grayscale compensation data;

step S22, generating color deviation compensation data of the display defect, according to the first compensation data and chrominance data of the preset grayscale, when the compensation data is the color deviation compensation data.

The demura data includes grayscale data and/or color deviation data. When only the grayscale data is considered, the sampled data of the preset grayscale is the grayscale data, and when the compensation data is the grayscale compensation data, the grayscale compensation data of the display defect is generated according to the first compensation data and the grayscale data of the preset grayscale.

When it is the color deviation compensation data, chromaticity data needs to be collected, in addition to grayscale data, chromaticity data also needs to be collected. That is, the data of the preset grayscale includes the grayscale data and the chromaticity data, the color deviation compensation data of the display defect is generated according to the first compensation data and the chromaticity data of the preset grayscale.

The data of the preset grayscale includes the grayscale data and the chromaticity data The compensation of the picture is more reasonable by considering both grayscale and color deviation, and the memory space is partially occupied by the data processing method of this embodiment, which reduces the memory space occupation and saves the cost while improving the picture quality.

Figure 6:
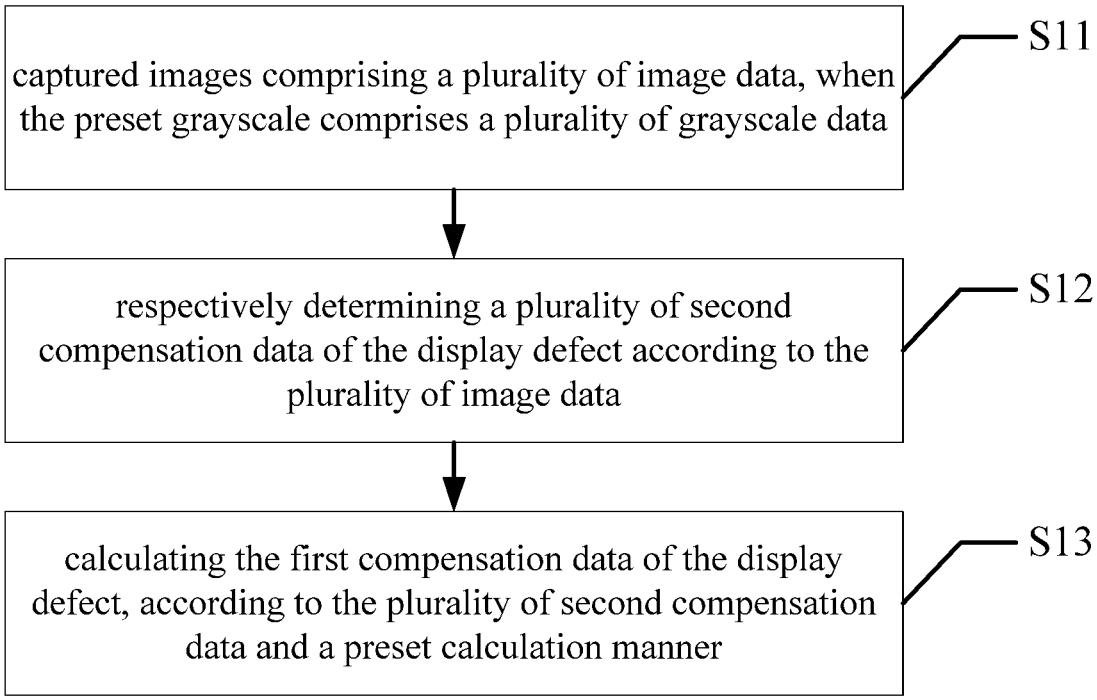
FIG. 6 is a flowchart diagram of determining first compensation data of display defect according to the image data in an embodiment of the present disclosure.

In some embodiments, referring to FIG. 6, the step of determining the first compensation data of the display defect according to the image data includes:

step S11, captured images including a plurality of image data, when the preset grayscale includes a plurality of grayscale data;

step S12, respectively determining a plurality of second compensation data of the display defect according to the plurality of image data;

step S13: calculating the first compensation data of the display defect, according to the plurality of second compensation data and a preset calculation manner.

In this embodiment, when the number of the grayscale is plural, the captured images will have multiple grayscale images, each captured image will have different second compensation data for display defects, and the final first compensation data will be calculated according to the corresponding calculation method according to the different grayscales, and the calculation method can be calculated in the way of average value or weight.

Optionally, in some embodiments, when the brightness compensation is only to be considered, the grayscale image is only to be detected. And different muras are presented in different grayscales, generally, muras are respectively detected in high, medium, and low gray levels, and finally demura data are averaged. Of course, the specific operations could be selected according to actual needs.

In this embodiment, different image data is captured by different grayscales, so as to obtain different compensation data, and the compensation data for demura is finally determined by the different compensation data, which reduces the occupied storage space and improves the image display effect.

Figure 7:
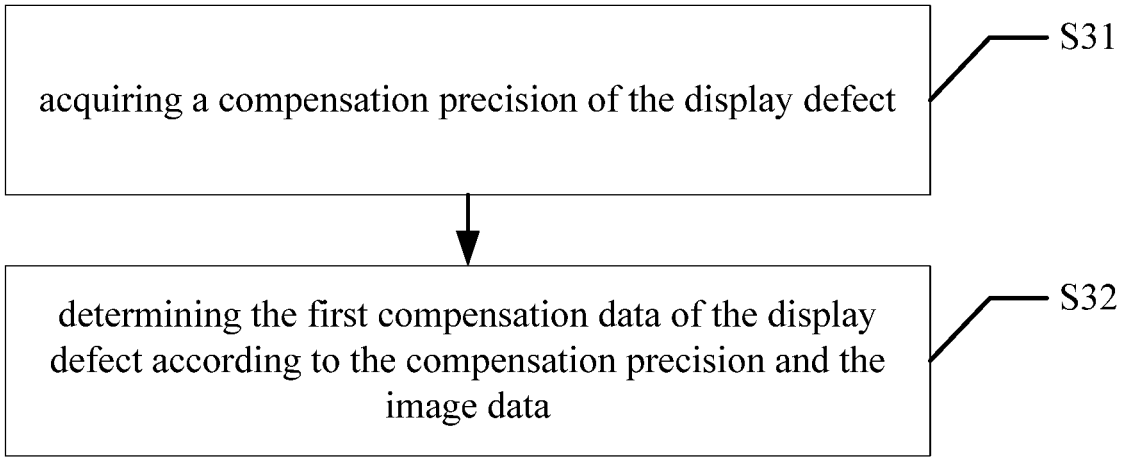
FIG. 7 is a flowchart diagram of determining first compensation data of display defect according to the image data in an embodiment of the present disclosure.

In an embodiment of the present application, referring to FIG. 7, the step of determining the first compensation data of the display defect according to the image data includes:

step S31: acquiring a compensation precision of the display defect;

step S32: determining the first compensation data of the display defect according to the compensation precision and the image data.

In this embodiment, the compensation accuracy would be affected by different requirements of various products. The products have different requirements, the compensation accuracies are different. Some products require a 90% yield and other products require an 80% yield, which correspond to different compensation accuracies and different degrees of repairing. When determining the compensation data, it is first to determine the compensation accuracy, namely to acquire the compensation accuracy of the display defect. After the compensation accuracy is determined, the first compensation data of the display defect is determined according to the compensation accuracy and the image data. The first compensation data would be affected by different image data and different compensation accuracy. By setting a corresponding relationship in advance, after determining the compensation accuracy and image data, the first compensation data is determined according to the corresponding relationship, so as to complete the compensation of the image.

In this embodiment, by acquiring different compensation accuracies, the requirements of different products are met, which not only ensures the product quality, but also reduces the occupation of the memory, and saves the costs.

It should be understood that, the process of demura compensating for the image of the display device includes: capturing the image with a high-resolution and high-precision CCD camera; analyzing pixel color distribution features based on data collected by the camera, and identifying the mura according to a related algorithm; generating demura data according to the mura data and a corresponding demura compensation algorithm; recording the demura data into a Flash ROM; re-capturing the image after being compensated, and confirming the mura has been eliminated; checking the image. The key of the present disclosure is to calculate the demura data, which is in a partial calculation instead of the whole of the compensation data. The data corresponding to the grayscale is not stored in the memory, it is not needed to store the whole part of the compensation data for each compensation data, thus reducing the occupied space and reducing the costs.

In addition, the embodiment of the present disclosure also provides a display device. The display device includes a display panel and a timing sequence controller connected to the display panel. The timing sequence controller is loaded with a data processing control apparatus, the display panel complete display operation under the control of the timing sequence controller, and the processing way of the data stored in the timing sequence controller is completed according to the data processing method in the above embodiments. The data processing method is loaded in a data compression apparatus for the timing sequence controller to call and start, so as to complete the data processing, thereby improving efficiencies of data processing and timing sequence controlling. The display device may be a mobile or fixed display device, such as a television, a mobile phone, a PAD, a machine display instrument, and so on. In the present disclosure, image data is captured by preset grayscale, and the compensation data of display defect is determined according to the captured image data. Because a part of the compensation data is stored in a memory, the other part is embodied in the form of the data of the preset grayscale. As such, there is no need to store the whole data of each compensation data, which reduces the storage space occupied by the compensation data, cuts the demands for the memory, saves the costs of the memory, and improves the operation efficiency of the timing sequence controller.

In addition, the embodiment of the present application also provides a computer-readable storage medium. The computer-readable storage medium stores a data processing program, the data processing program when being executed by a processor performs the data processing method described as the above embodiments.

It's to be clarified that the term "include", "comprise" or any other variants thereof is intended to encompass a non-exclusive inclusion, such that a process, method, device, or system including a series of elements not only includes those elements, but also includes other elements that are not explicitly listed, or elements that are inherent to such a process, method, device, or system. In the absence of more restrictions, an element defined by the phrase "including one . . . " does not exclude the existence of additional identical elements in the process, method, device, or system that includes the element.

The numbers of the embodiments according to the present disclosure are merely for description, and do not represent for the advantages and disadvantages of the embodiments.

According to the description of the above-mentioned embodiments, the skilled in the art can clearly understand that the method of embodiments above may be implemented by means of software plus a necessary general hardware platform, of course, also by means of hardware, but in many cases the former is a better implementation. Based on the understanding, the technical solution of the present disclosure can be embodied in the form of a software product in essence or in part contributing to the prior art. The software product is stored in a storage medium (such as a ROM/RAM, a magnetic disk, an optical disk) as described above, including a plurality of instructions for causing a terminal device (which may be a mobile phone, a computer, a server, an air conditioner, or a network device, and so on) to execute the method described in various embodiments according to the present disclosure.

The foregoing description merely portrays some illustrative embodiments in accordance with the disclosure and therefore is not intended to limit the patentable scope of the disclosure. Any equivalent structure or flow transformations that are made taking advantage of the specification and accompanying drawings of the disclosure and any direct or indirect applications thereof in other related technical fields shall all fall in the scope of protection of the disclosure.

What is claimed is:

1. A data processing method, wherein, the data processing method comprises:

determining image data captured in preset grayscale;

determining first compensation data of display defect according to the image data, wherein the first compensation data is data for compensation in addition to data of the preset grayscale, the first compensation data is to be recorded in a memory of a display apparatus, and the data of the preset grayscale is not to be recorded in the memory of the display apparatus; and composing compensation data of the display defect by the first compensation data and the data of the preset grayscale;

for the compensation data, recording only the first compensation data into the memory of the display apparatus in a form of a relative value, wherein each first compensation data occupies only one address of the memory; and repairing the display defect according to the compensation data which is generated by the recorded first compensation data and the data of the preset grayscale, when compensating a display image.

2. The data processing method according to claim 1, wherein, the operation of composing compensation data of the display defect by the first compensation data and the data of the preset grayscale comprises:

composing grayscale compensation data of the display defect by the first compensation data and grayscale data of the preset grayscale, when the compensation data is the grayscale compensation data; and composing color deviation compensation data of the display defect by the first compensation data and chrominance data of the preset grayscale, when the compensation data is the color deviation compensation data.

3. The data processing method according to claim 2, wherein, the operation of determining first compensation data of display defect according to the image data comprises:

captured images comprising a plurality of image data, when the preset grayscale comprises a plurality of grayscale data;

respectively determining a plurality of second compensation data of the display defect according to the plurality of image data; and calculating the first compensation data of the display defect, according to the plurality of second compensation data and a preset calculation manner.

4. The data processing method according to claim 2, wherein, the operation of determining first compensation data of display defect according to the image data comprises:

acquiring a compensation precision of the display defect; and determining the first compensation data of the display defect according to the compensation precision and the image data.

5. The data processing method according to claim 1, wherein, after the operation of determining image data captured in preset grayscale, the data processing method further comprises:

determining whether the display defect is existed in a display apparatus according to the image data and a preset identification algorithm; and if yes, performing the operation of determining the first compensation data of display defect according to the image data.

6. The data processing method according to claim 5, wherein, the preset identification algorithm comprises identification manners of contrast enhancement, brightness gradient, and color deviation calculation.

7. The data processing method according to claim 1, wherein, the operation of for the compensation data, recording only the first compensation data into a memory of a display apparatus in a form of a relative value comprises:

compressing the first compensation data; and recording the compressed first compensation data into the memory of the display apparatus.

8. The data processing method according to claim 7, wherein, the operation of compressing the first compensation data comprises:

acquiring a first compensation data table of the display device, and extracting the compensation data according to an extraction period comprising four adjacent rows based on the first compensation data table.

9. The data processing method according to claim 8, wherein, the operation of extracting the compensation data according to an extraction period comprising four adjacent rows based on the first compensation data table comprises:

extracting the compensation data of odd columns in the first row;

extracting the compensation data of even columns in the third row and extracting the compensation data of the first column in the third row.

10. The data processing method according to claim 1, wherein, the operation of determining first compensation data of display defect according to the image data comprises:

captured images comprising a plurality of image data, when the preset grayscale comprises a plurality of grayscale data;

respectively determining a plurality of second compensation data of the display defect according to the plurality of image data; and calculating the first compensation data of the display defect, according to the plurality of second compensation data and a preset calculation manner.

11. The data processing method according to claim 1, wherein, the operation of determining first compensation data of display defect according to the image data comprises:

acquiring a compensation precision of the display defect; and determining the first compensation data of the display defect according to the compensation precision and the image data.

12. A display device, wherein, the display device comprises a memory, a processor, and a computer program stored on the memory and executable on the processor, the computer program being executed by the processor to implement the following operations:

determining image data captured in preset grayscale;

determining first compensation data of display defect according to the image data, wherein the first compensation data is data for compensation in addition to data of the preset grayscale, the first compensation data is to be recorded in a memory of a display apparatus, and the data of the preset grayscale is not to be recorded in the memory of the display apparatus; and composing compensation data of the display defect by the first compensation data and the data of the preset grayscale;

for the compensation data, recording only the first compensation data into a memory of a display apparatus in a form of a relative value, wherein each first compensation data occupies only one address of the memory; and repairing the display defect according to the compensation data which is generated by the recorded first compensation data and the data of the preset grayscale, when compensating a display image.

13. The display device according to claim 12, wherein, the display device comprises a display panel and a timing sequence controller connected to the display panel, the timing sequence controller is loaded with a data processing control device, and the display panel performs display under the control of the timing sequence controller.

14. The display device of claim 12, wherein, the operation of composing compensation data of the display defect according to the first compensation data and the data of the preset grayscale comprises:

composing grayscale compensation data of the display defect by the first compensation data and grayscale data of the preset grayscale, when the compensation data is the grayscale compensation data; and composing color deviation compensation data of the display defect by the first compensation data and chrominance data of the preset grayscale, when the compensation data is the color deviation compensation data.

15. The display device of claim 12, wherein, the operation of determining first compensation data of display defect according to the image data comprises:

captured images comprising a plurality of image data, when the preset grayscale comprises a plurality of grayscale data;

respectively determining a plurality of second compensation data of the display defect according to the plurality of image data; and calculating the first compensation data of the display defect, according to the plurality of second compensation data and a preset calculation manner.

16. The display device according to claim 12, wherein, the operation of determining first compensation data of display defect according to the image data comprises:

acquiring a compensation precision of the display defect; and determining the first compensation data of the display defect according to the compensation precision and the image data.

17. A non-transitory computer-readable storage medium, wherein, the computer-readable storage medium stores a data processing program, the data processing program when being executed by a processor performs the following operations:

determining image data captured in preset grayscale;

determining first compensation data of display defect according to the image data, wherein the first compensation data is data for compensation in addition to data of the preset grayscale, the first compensation data is to be recorded in a memory of a display apparatus, and the data of the preset grayscale is not to be recorded in the memory of the display apparatus; and composing compensation data of the display defect by the first compensation data and the data of the preset grayscale;

for the compensation data, recording only the first compensation data into a memory of a display apparatus in a form of a relative value, wherein each first compensation data occupies only one address of the memory; and repairing the display defect according to the compensation data which is generated by the recorded first compensation data and the data of the preset grayscale, when compensating a display image.

* * * * *